US007681332B2

(12) United States Patent
Allen

(10) Patent No.: US 7,681,332 B2
(45) Date of Patent: Mar. 23, 2010

(54) POST PEDICURE SHOE

(76) Inventor: Kathy Allen, 3892 Maple Ave., Prestonsburg, KY (US) 41653

( * ) Notice: Subject to any disclaimer, the term of this patent is extended or adjusted under 35 U.S.C. 154(b) by 828 days.

(21) Appl. No.: 11/481,595

(22) Filed: Jul. 6, 2006

(65) Prior Publication Data

US 2007/0011915 A1 Jan. 18, 2007

Related U.S. Application Data

(60) Provisional application No. 60/698,659, filed on Jul. 12, 2005.

(51) Int. Cl.
*A43B 7/26* (2006.01)

(52) U.S. Cl. ..... 36/94; 36/101; D2/916

(58) Field of Classification Search ..... 36/101, 36/94, 72 R, 77 R, 138, 100; D2/916, 962
See application file for complete search history.

(56) References Cited

U.S. PATENT DOCUMENTS 2,507,120 A * 5/1950 Shapiro ..... 36/11.5
3,299,893 A * 1/1967 Collina ..... 36/140
4,061,138 A * 12/1977 Bernstein ..... 602/11
4,177,583 A * 12/1979 Chapman ..... 36/77 R
4,207,880 A * 6/1980 Zinkovich ..... 602/30
4,454,872 A * 6/1984 Brouhard ..... 602/11
4,958,447 A * 9/1990 DuPree ..... 36/101
5,065,531 A * 11/1991 Prestridge ..... 36/100
5,280,679 A * 1/1994 Edelman ..... 34/66
5,483,757 A * 1/1996 Frykberg ..... 36/101
5,778,565 A * 7/1998 Holt et al. ..... 36/110
5,926,978 A * 7/1999 Smith ..... 36/101
5,946,823 A * 9/1999 Yates ..... 36/11.5
6,272,771 B1 * 8/2001 Rodi ..... 36/77 R
6,678,971 B2 * 1/2004 Brooks ..... 36/94
6,898,873 B2 * 5/2005 Schenone ..... 36/112
7,107,707 B2 * 9/2006 Schenone ..... 36/101
7,134,225 B2 * 11/2006 Ashton ..... 36/94
7,296,367 B2 * 11/2007 Kipnes ..... 36/94
7,340,852 B1 * 3/2008 Tai ..... 36/100

* cited by examiner

*Primary Examiner*—Jila M Mohandesi
(74) *Attorney, Agent, or Firm*—Dale J. Ream

(57) ABSTRACT

A post-pedicure shoe according to the present invention includes a sole having front and rear ends and upper and lower surfaces. A foam cushion is situated atop the sole upper layer for comfortably accommodating a person's foot. The shoe includes a toe cover pivotally coupled to the front of the sole and is movable between open and closed configurations. The toe cover includes a configuration for protecting a person's toe nails from debris or contact with the shoe while still enabling the person to walk around. The shoe also includes a plurality of toe separators adjacent the sole front end for keeping the toes from touching one another while the shoe is worn.

4 Claims, 3 Drawing Sheets

POST PEDICURE SHOE

CROSS REFERENCE TO RELATED APPLICATION

This non-provisional patent application claims the benefit of provisional application Ser. No. 60/698,659 filed on Jul. 12, 2005.

FIELD OF THE INVENTION

The present invention relates generally to footwear and, more particularly, to a reusable pedicure shoe that maintains a person's toes in separated positions and that protects painted toe nails from outside elements. The shoe is designed to effectively prevent damage to the treated toes while enabling the wearer to walk and move about comfortably following a pedicure.

BACKGROUND OF THE INVENTION

Each year millions of women and men undergo professional treatment of their toenails, otherwise referred to as pedicures. After a pedicure is performed, there is a need to protect the foot and freshly painted toenails until the nail polish and any exfoliate dries. If a polish is applied to the nails of the toe during a pedicure, the toes must be maintained in a separated condition to prevent them from coming in contact with any outside elements.

Various proposals have been made in the prior art for protecting a person's toenails from being contacted by the person's shoes or other objects. Although assumably effective for their intended purposes, the existing devices and proposals do not provide a shoe giving the person full mobility while maintaining separation of the toes and protection from contact with the shoe or other influences or objects.

Therefore, it would be desirable to have a post-pedicure shoe that provides mobility to a person having just received a pedicure or polish, maintains separation of the toes, includes a cover protecting polished toenails from being touched, and which is cushioned.

SUMMARY OF THE INVENTION

Therefore, a post-pedicure shoe according to the present invention includes a cushioned sole and a toe cover pivotally coupled to a front of the sole that is movable between open and closed configurations. The shoe also includes a plurality of cushioned toe spacers for maintaining polished toes in spaced apart relation following a pedicure.

Therefore, a general object of this invention is to provide a post-pedicure shoe for protecting the polished nails of a person having just received a pedicure.

Another object of this invention is to provide a post-pedicure shoe, as aforesaid, that allows the toenails of a person to be simultaneously exposed to air and yet protected from any disturbance.

Still another object of this invention is to provide a post-pedicure shoe, as aforesaid, that maintains a person's toes in separated positions so as not to touch one another.

Yet another object of this invention is to provide a post-pedicure shoe, as aforesaid, that is cushioned and maintains an arch support.

A further object of this invention is to provide a post-pedicure shoe, as aforesaid, having a toe cover that may be conveniently opened and closed without disrupting the toenails.

Other objects and advantages of the present invention will become apparent from the following description taken in connection with the accompanying drawings, wherein is set forth by way of illustration and example, an embodiment of this invention.

DESCRIPTION OF THE PREFERRED EMBODIMENT

Figure 1:
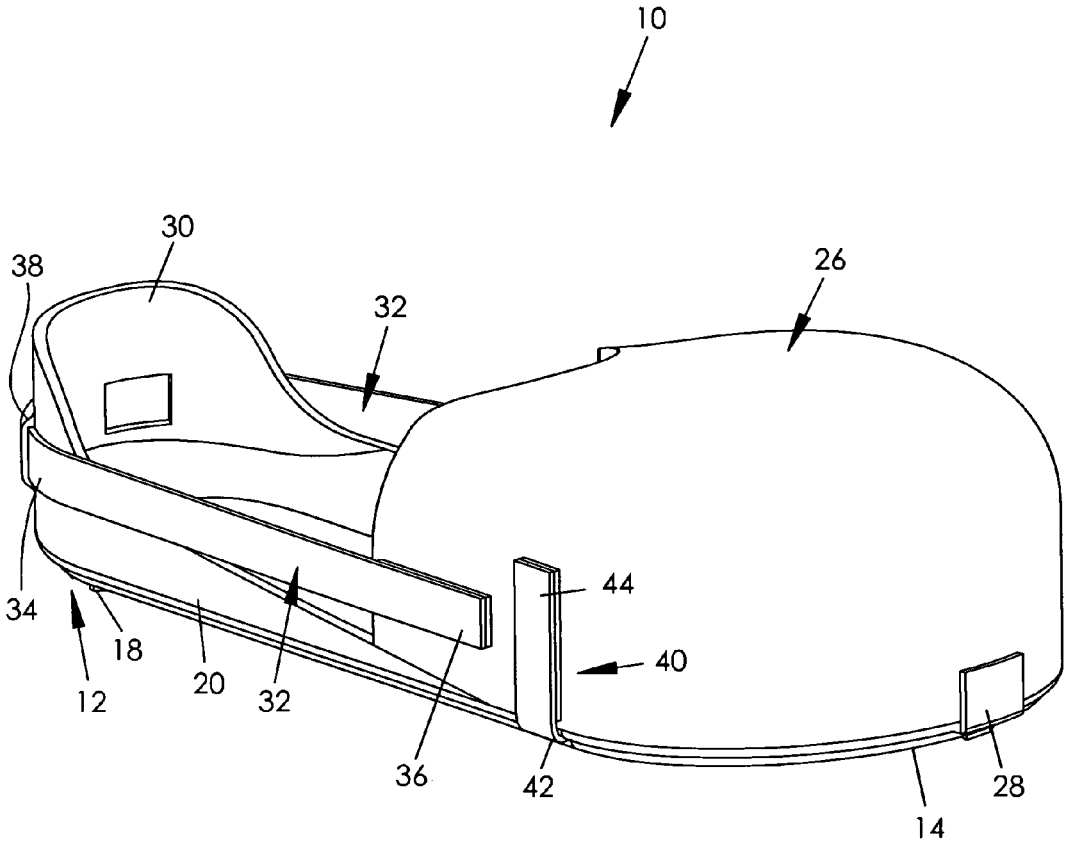
FIG. 1 is a perspective view of a post-pedicure shoe according to the present invention in a closed and secured configuration.

A post-pedicure shoe according to the present invention is described in detail with reference to FIGS. 1 to 4 of the accompanying drawings. The post-pedicure shoe 10 generally includes a sole 12 with a foam cushion 20 and a toe cover 26.

More particularly, the sole 12 includes a configuration that generally approximates the size and shape of a human foot. The sole 12 includes opposed front 14 and rear 16 ends and presents upper and lower 18 surfaces. Side edges of the sole 10 may be tapered and scalloped to allow proper size and a snug fit. The lower surface 18 of the sole 10 preferably includes a rough surface so as not to be slippery.

A foam cushion 20 is connected to and situated atop the upper layer of the sole 12 for supporting a person's foot. The cushion 20 is preferably about ½ inch thick and may be constructed from a foam rubber. The cushion 20 includes an arch support area 22 positioned approximately midway between the front 14 and rear 16 ends of the sole 12 for maintaining the foot in a comfortable and stable position.

Figure 4:
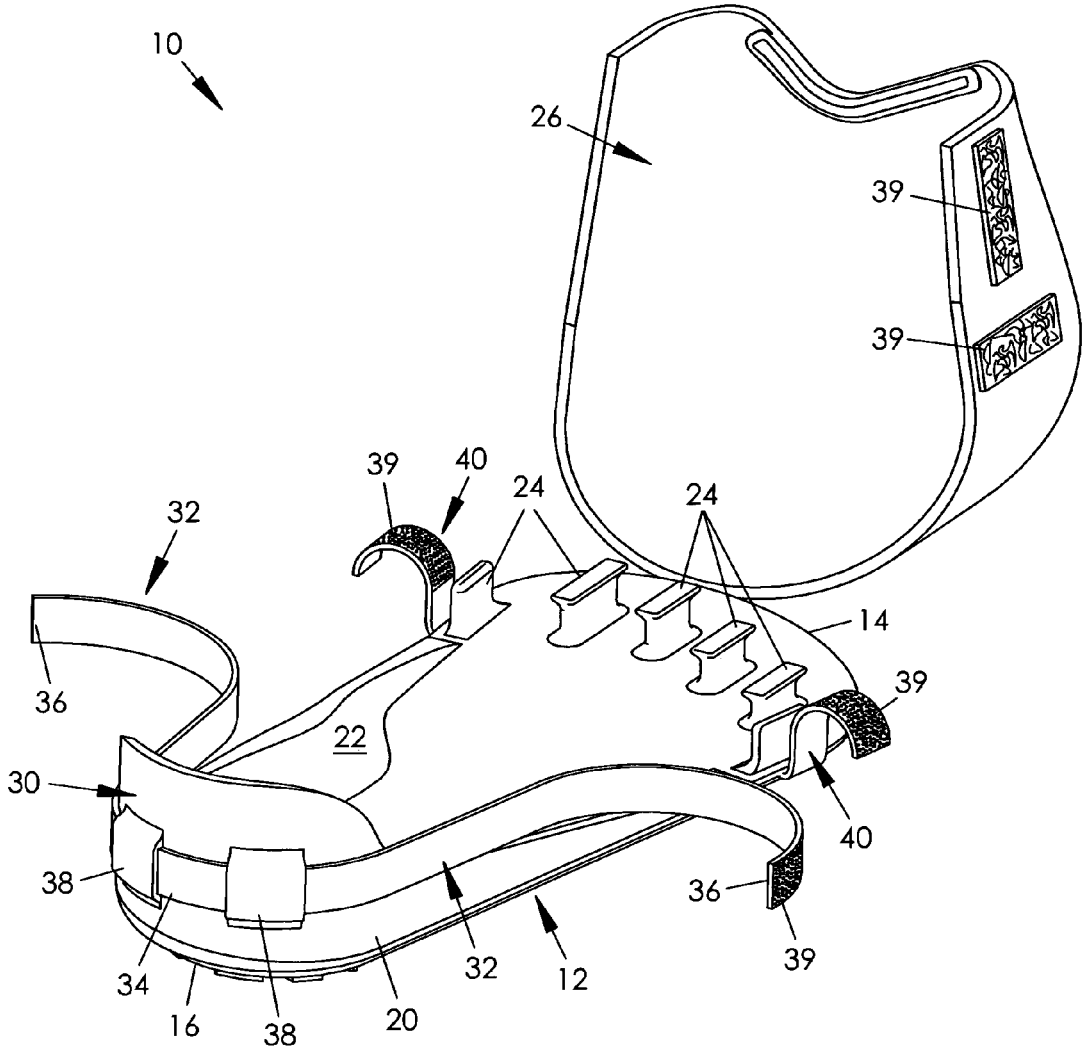
FIG. 4 is another perspective view of the post-pedicure shoe as in FIG. 1 in an open and fully released configuration.

A plurality of toe spacers 24 are fixedly attached to and situated atop the foam cushion 20 substantially adjacent the front end 14 of the sole 12 (FIG. 4). The toe spacers 24 are spaced apart from one another and arranged in a configuration that simulates or approximates the toes of a person. Preferably, each toe spacer 24 is constructed of a foam material that fits comfortably between a person's toes in use, although it is understood that other soft and semi-flexible materials may also be used. Having the toes separated is particularly advantageous for keeping a person's toes separated while nail polish or other similar toenail treatments may still be set.

The post-pedicure shoe 10 includes a toe cover 26 that is pivotally mounted to a front end of the sole 12 and movable between open (FIG. 4) and closed (FIG. 1) configurations. Preferably, the toe cover 26 is pivotally coupled to the sole 12 with a hinge 28 although other similar fasteners would also be suitable. The toe cover 26 includes a generally hemispherical configuration although a full dome shaped configuration would also be suitable. In either case, the toe cover 26 includes a top wall with depending side walls and defines an open back and bottom (FIG. 4). The toe cover 26 may be constructed of a rigid plastic material for best protection of a person's toes although a semi-flexible or soft material may also be suitable. The toe cover 26 does not bear against a person's toes in either the open or closed configurations. The toe cover 26 protects a person's toenails and polish therefrom following a pedicure.

The shoe 10 includes a heel support member 30 connected to the rear end 16 of the sole 12 and extending upwardly therefrom (FIG. 1). The heel support member 30 aids in maintaining a person's foot in proper position upon the cushion 20.

As shown in all of the figures, the post-pedicure shoe 10 includes an elongate strap 32 having a first end 34 coupled to the rear end 16 of the sole 12 and a pair of free second ends 36 extending and spaced apart therefrom. More particularly, the strap 32 may be a continuous member that is merely connected to the heel support member 30 by extending through one or more strap loops 38.

Preferably, an inner surface of each strap second end 36 includes one of a hook and loop fastener. It is noted that all hook and loop fasteners referred to herein are referenced using reference numeral 39. Each side wall of the toe cover 26 includes another one of a hook and loop fastener that is complementary to the fastener on a respective strap second end 36. Accordingly, respective second ends 36 of the strap 32 may be releasably connected to side walls of the toe cover 26 when the toe cover 26 is at the closed configuration (FIG. 1). Of course, other types of fasteners would also be suitable, such as snaps, buckles, adhesive or the like.

The post-pedicure shoe 10 may also include one or more closure member(s) 40 for further securing the toe cover 26 at the closed configuration. Each closure member 40 includes a first portion 42 (or first end) connected to the sole 12 and a second portion 44 extending outwardly therefrom (FIG. 4). Each second portion 44 (free end) may be releasably coupled to a side wall of the toe cover 26 in a manner substantially similar to the means described above with specific reference to the elongate strap 32.

Figure 2:
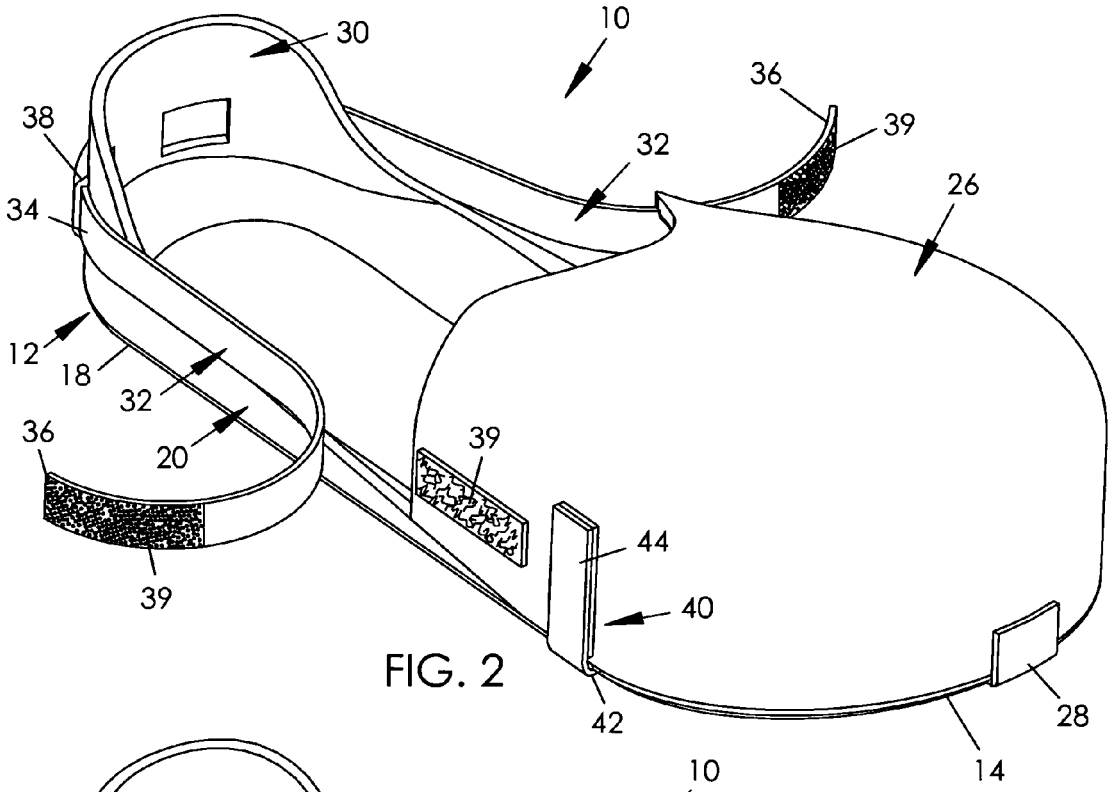
FIG. 2 is a another perspective view of the post-pedicure shoe with the securing straps in a closed but partially released configuration.
Figure 3:
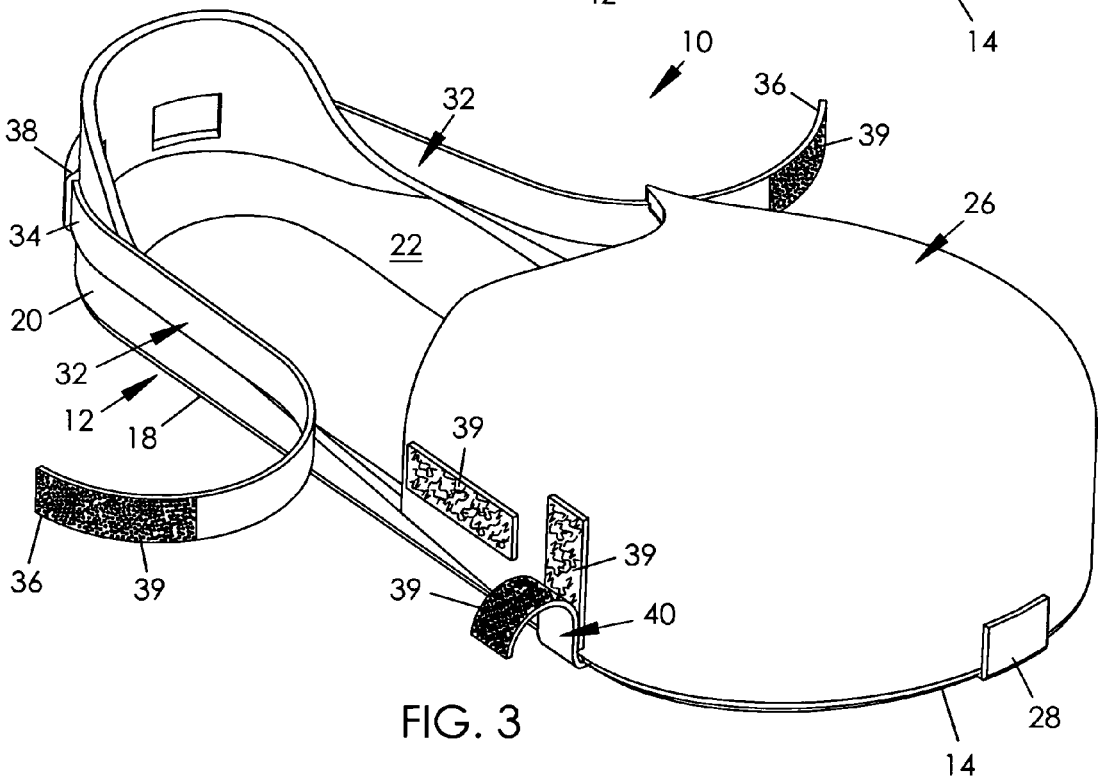
FIG. 3 is another perspective view of the post-pedicure shoe as in FIG. 1 in a closed but fully released configuration.

It is understood that the straps 32, closure members 40, and toe cover 26 may be placed in several different configurations. Specifically, the toe cover 26 is deemed to be in a closed and secured configuration when the toe cover 26 is closed and both the straps 32 and closure members 40 are affixed to the toe cover side walls (FIG. 1). The toe cover 26 is deemed to be in a closed but partially released configuration when the toe cover 26 is closed and the elongate straps 32 are released (FIG. 2). Further, the toe cover 26 is deemed to be in a closed but fully released configuration when the toe cover 26 remains closed but both the straps 32 and closure members 40 are released (FIG. 3). And, finally, the toe cover 26 is deemed to be in an open configuration when the toe cover 26 is open and both the straps 32 and closure members 40 are released (FIG. 4).

Finally, it is understood that the shoes may be made in a variety of colors and patterns and remain fairly inexpensive. Some could be customized with a salon name imprinted on the top and used as an advertising tool.

In use, a person may put on a post-pedicure shoe 10 following a pedicure or application of toenail polish by first manipulating the shoe to the open configuration (FIG. 4) and stepping onto the cushion 20 such that the toes are separated about the toe spacers 24. The toe cover 26 may then be lowered to the closed configuration and the straps 32 and closure members 40 secured thereto (FIG. 1). With a pair of post-pedicure shoes strapped on, a person is able to walk around and carry out normal activities without restriction and without worrying that newly applied nail polish or other pedicure applications will be disturbed. In addition to the pedicure market, the shoe may also serve a purpose in the orthopedic industry by keeping an injured and/or broken toe secure and protected.

What is claimed is as follows:

1. A post-pedicure shoe, comprising:

a sole having front and rear ends and opposed upper and lower surfaces, said sole having a semi-rigid construction;

a foam cushion attached and situated atop said upper layer of said sole and extending between said front and rear ends;

wherein said foam cushion includes an arch support area situated between said front and rear ends;

a toe cover pivotally coupled to a tip of said front end of said sole with a hinge and movable between open and closed configurations, said toe cover having a generally dome-shaped configuration having a top wall with depending side walls defining a hollow interior, open bottom, and an open back, whereby to protect but not contact a user's toes when at said closed configuration;

wherein:

at said open configuration said toe cover is positioned such that said side walls and said open back are tilted forward above said front end of said sole;

at said closed configuration said toe cover is positioned such that said top wall of said toe cover is generally parallel with said sole;

said toe cover is constructed of a hard plastic material;

a plurality of toe separators fixedly attached atop said foam cushion, said separators being spaced apart and situated substantially adjacent a front edge of said sole front end;

wherein said plurality of toe separators are displaced a distance from said front edge of said sole so that a user's toes do not extend beyond said sole front edge when situated upon said foam cushion and when said toe cover is at said closed configuration;

a heel support member connected to said rear end of said sole and extending upwardly therefrom;

an elongate strap having a first end coupled to said rear end of said sole and a second end extending longitudinally therefrom;

means for releasably attaching said second end to said toe cover when said toe cover is at said closed configuration;

at least one closure member having a first portion connected to said sole generally adjacent to said front end of said sole and a second portion extending therefrom;

means for releasably attaching said second portion to said toe cover when said toe cover is at said closed configuration.

2. The post-pedicure shoe as in claim 1 wherein:

said means for releasably attaching said second end to said toe cover includes complementary hook and loop fasteners; and said means for releasably attaching said second portion to said toe cover includes complementary hook and loop fasteners.

3. The post-pedicure shoe as in claim 1 wherein the toe cover is pivotally coupled to the sole with a hinge.

4. The post-pedicure shoe as in claim 1 wherein said plurality of toe separators are spaced apart in a configuration approximating the toes of a person.

* * * * *